US009028387B2

(12) United States Patent
Eiken

(10) Patent No.: US 9,028,387 B2
(45) Date of Patent: May 12, 2015

(54) DECANTER CENTRIFUGE WITH ENERGY RECOVERY STRUCTURE

(75) Inventor: Jon Eiken, Zurich (CH)

(73) Assignee: Alfa Laval Corporate AB, Lund (SE)

( * ) Notice: Subject to any disclaimer, the term of this patent is extended or adjusted under 35 U.S.C. 154(b) by 986 days.

(21) Appl. No.: 13/142,488

(22) PCT Filed: Dec. 23, 2009

(86) PCT No.: PCT/IB2009/055933

§ 371 (c)(1),
(2), (4) Date: Sep. 29, 2011

(87) PCT Pub. No.: WO2010/076752

PCT Pub. Date: Jul. 8, 2010

(65) Prior Publication Data

US 2012/0028782 A1 Feb. 2, 2012

(30) Foreign Application Priority Data

Dec. 30, 2008 (DK) ..... 2008 01848

(51) Int. Cl.
*B04B 1/20* (2006.01)

(52) U.S. Cl.
CPC ..... *B04B 1/20* (2013.01); *B04B 2001/2075* (2013.01); *B04B 2001/2083* (2013.01)

(58) Field of Classification Search
CPC ..... B04B 1/20; B04B 2001/2075; B04B 2001/2041
USPC ..... 494/53, 54, 56, 57, 60; 210/380.1, 210/380.3
See application file for complete search history.

(56) References Cited

U.S. PATENT DOCUMENTS

| | | | | | |
|---|---|---|---|---|---|
| 3,580,492 | A | * | 5/1971 | Schnittger et al. | 494/53 |
| 3,858,794 | A | * | 1/1975 | Nilson et al. | 494/4 |
| 4,334,647 | A | | 6/1982 | Taylor | |
| 4,556,873 | A | | 12/1985 | Yamada et al. | |
| 4,575,370 | A | * | 3/1986 | LaMontagne | 494/56 |
| 4,764,163 | A | * | 8/1988 | Caldwell | 494/56 |
| 4,950,219 | A | * | 8/1990 | Luchetta | 494/53 |

(Continued)

FOREIGN PATENT DOCUMENTS

| | | | |
|---|---|---|---|
| DE | 10021642 | A1 | 11/2001 |
| DE | 102010061563 | A1 * | 6/2012 |

(Continued)

OTHER PUBLICATIONS

International Search Report; International Application No. PCT/IB2009/055933, Date Mailed Apr. 21, 2010.

*Primary Examiner* — Charles Cooley
(74) *Attorney, Agent, or Firm* — MKG, LLC

(57) ABSTRACT

In a decanter centrifuge a bowl is provided and rotates in use around a horizontal axis of rotation, a base plate provided at one longitudinal end of said bowl, the base plate having an internal side and an external side, an outlet opening provided in said base plate, the outlet opening extending through a first angular interval relative to the axis of rotation, and a wall projecting from the external side of said base plate, wherein the wall extends from the vicinity of the outlet opening towards a rim of the base plate, the wall extending through a second angular interval, the second angular interval being at least 30°, and the wall having in a radial plane perpendicular to the axis of rotation an inclination relative to the radial direction of at least 60°.

27 Claims, 6 Drawing Sheets

(56) References Cited

U.S. PATENT DOCUMENTS

| | | | | |
|---|---|---|---|---|
| 5,147,277 | A | 9/1992 | Shapiro | |
| 5,217,428 | A * | 6/1993 | Schlip et al. | 494/56 |
| 5,685,819 | A | 11/1997 | Nishida et al. | |
| 7,022,061 | B2 * | 4/2006 | Leung et al. | 494/56 |
| 8,157,716 | B2 * | 4/2012 | Madsen | 494/56 |
| 8,485,959 | B2 * | 7/2013 | Madsen et al. | 494/56 |
| 2004/0072667 | A1 * | 4/2004 | Leung et al. | 494/56 |
| 2004/0072668 | A1 * | 4/2004 | Leung | 494/56 |
| 2008/0248940 | A1 | 10/2008 | Figgener et al. | |
| 2010/0167901 | A1 * | 7/2010 | Madsen et al. | 494/60 |
| 2011/0039680 | A1 * | 2/2011 | Madsen | 494/56 |
| 2011/0143906 | A1 * | 6/2011 | Geehan et al. | 494/56 |
| 2012/0021889 | A1 * | 1/2012 | Eiken | 494/52 |
| 2012/0028782 | A1 * | 2/2012 | Eiken | 494/2 |
| 2013/0274084 | A1 * | 10/2013 | Madsen et al. | 494/60 |
| 2013/0310242 | A1 * | 11/2013 | Madsen et al. | 494/57 |
| 2014/0038806 | A1 * | 2/2014 | Lendzian et al. | 494/56 |
| 2014/0051565 | A1 * | 2/2014 | Terholsen et al. | 494/53 |
| 2014/0148326 | A1 * | 5/2014 | Reiff et al. | 494/56 |
| 2014/0235423 | A1 * | 8/2014 | Pasol et al. | 494/56 |

FOREIGN PATENT DOCUMENTS

| | | | | |
|---|---|---|---|---|
| EP | 1588769 | A1 * | 10/2005 | B04B 11/02 |
| FR | 2660580 | A | 4/1990 | |
| JP | 11179236 | A | 6/1999 | |
| JP | 11-197547 | A | 7/1999 | |
| JP | 11-197548 | A | 7/1999 | |
| WO | 9427726 | | 12/1994 | |
| WO | 2008138345 | A1 | 11/2008 | |

* cited by examiner

DECANTER CENTRIFUGE WITH ENERGY RECOVERY STRUCTURE

FIELD OF THE INVENTION

The present invention relates to a decanter centrifuge for separating a first substance and a second substance with different densities comprising a bowl rotatable around a horizontal axis of rotation in a direction of rotation. The axis of rotation extends in a longitudinal direction of the bowl, and in a radial direction extending perpendicular to the longitudinal direction. A base plate is provided at one longitudinal end of the bowl. The base plate has an internal side and an external side. An outlet opening is provided in the base plate for discharge of one of the substance. The outlet opening extends through a first angular interval relative to the axis of rotation. A wall projects from the external side of the base plate for guiding the substance discharged from the outlet opening in a direction opposite a direction of rotation of the bowl to recover kinetic energy from the substance.

Due to ever increasing energy prices combined with the relatively large energy consumption related to running decanter centrifuge installations energy recovery in relation to decanter centrifuges is becoming increasingly relevant. In the prior art, several solutions has been proposed to recover energy used in decanter centrifuges.

BACKGROUND

A decanter centrifuge of the type described above is known from JP 11-179236 that describes energy recovery by providing at the discharge opening of the bowl of the centrifuge a weir plate with an arcuate wall extending in a direction perpendicular to the weir plate. The arcuate wall is displaced from the edge of the discharge opening. Furthermore, the arcuate wall extends in a direction opposite the direction of rotation of the bowl. Generally, in decanter centrifuges, the liquid phase is discharged away from the decanter centrifuge into a sump.

WO 94/27726 discloses a centrifugal separator having a vertically aligned axis of rotation, in which energy is recovered by providing in the outlet chamber of the centrifugal separator a plate with a central hole and having closed channels extending axially from the plate towards the top of the outlet chamber and radially from the central hole towards the rim of the plate with a radius of curvature being, essentially in each point, smaller than the curve of an involute of a substance discharged through said central hole. The axis of rotation of the centrifugal separator extends through the centre of the central hole of the plate. Generally this arrangement is provided at the transition of the liquid from one liquid chamber to another within the centrifugal separator.

A problem with the known decanter centrifuge is that energy contained in the discharged substance, generally being a liquid, is lost in the transition between hole and wall. Particularly, discharged substance flowing over the overflow edge of the weir plate tends to cling to the outside of the weir plate thereby being accelerated which is energy consuming thus causing energy loss.

Further, the feed is accelerated to a rotational speed on entering into the bowl and the energy thus consumed is lost when the liquid phase exits over a weir at the outlets in the base plate. The decanter centrifuge of above-mentioned JP 11-179236 seeks to regain the lost energy by providing the said arcuate wall. However, the amount of energy thereby regained remains relatively small. There is, in other words, still a significant amount of energy lost in the separation process.

In one aspect, the present invention therefore aims at providing a decanter centrifuge that eliminates or reduces the problems mentioned above, thereby obtaining an improved energy recovery.

SUMMARY OF THE INVENTION

According to a first aspect of the invention this object is achieved by providing a decanter centrifuge of the art mentioned in the first paragraph in which the wall extends from the vicinity of the outlet opening towards a rim of the base plate, said wall extending through a second angular interval adjacent the first angular interval, said second angular interval being at least 30°, preferably at least 45°, more preferably at least 60°, and said wall having in a radial plane perpendicular to the axis of rotation an inclination relative to the radial direction of at least 60°, preferably at least 70°, more preferably at least 75°.

Placing the wall such that it extends from the vicinity of the outlet opening provides for a transition from outlet opening to wall having very little or even no energy loss. Further, providing the wall with a larger angular extension, i.e. a larger extension through the second angular interval, or in other words providing a longer wall, has been shown to provide for recovery of a larger quantity of energy, generally such that the longer the wall the larger the energy recovery. Also, providing the wall with an inclination in the radial plane relative to the radial direction, such that the curvature of the wall lies well within the path of an involute of the substance discharged through the outlet opening has been shown to provide for a significantly improved energy recovery. It has been shown, that overall an extra energy saving corresponding to between 30 kW and 40 kW on a relatively large decanter centrifuge becomes possible in this way.

According to a preferred embodiment of the invention the inclination of the wall relative to the radial direction is increasing through the second angular interval in a direction opposite the direction of rotation of the bowl, thereby providing for a further improved energy recovery. Furthermore providing the wall as a curved wall generally reduces turbulence in the discharged substance, thereby further increasing the power recovery.

According to a further preferred embodiment of the invention the outlet is radially away from the axis of rotation delimited by a weir edge, the wall extending through the first angular interval along said weir edge, the wall and the weir edge having in at least a major part of the first angular interval in a radial plane perpendicular to the axis of rotation an inclination relative to the radial direction of at least 60°, preferably at least 70°, more preferably at least 75°.

By providing the weir edge of the outlet and the wall with substantially identical inclinations, it is ensured that they extend in parallel, thus providing for that the previously mentioned very little or even no energy loss arising from providing the wall such that it extends from the vicinity of the outlet opening is maintained regardless of the level of substance or liquid in the bowl of the decanter centrifuge.

According to a preferred embodiment of the invention the wall comprises a raised part opposite the base plate, the wall providing an open channel for guiding the substance discharged, whereby the risk of discharged substance escaping by flowing over the edge of the wall opposite the base plate is minimized, thus further optimizing the energy recovery.

According to a preferred embodiment of the invention the channel has a width, said width decreasing through the second angular interval in a direction opposite the direction of rotation, thereby reducing the wet surface of the channel and thus reducing friction to the benefit of energy recovery.

According to a preferred embodiment of the invention the outlet opening is delimited by a circumferential edge comprising three parts, a first part constituting the weir edge, a second part extending between the first and the second angular interval from the weir edge towards the axis of rotation and a third part connects the first part and the second part. Thereby is provided for a well-defined outlet opening while maintaining the above advantages.

According to a preferred embodiment of the invention the base plate comprises a plurality of, preferably three, outlet openings, and a plurality of, preferably three, walls projecting from said base plate, particularly a wall for each outlet opening, thereby increasing the amount of substance that may be discharged per time unit.

Normally such a plurality of outlet openings are provided in the base plate placed equidistantly on a common radius.

According to a preferred embodiment of the invention the decanter centrifuge further comprises a slide valve body adapted for covering an adjustable part of the outlet opening, thereby providing for adjustable setting of the level of substance or liquid in the bowl of the decanter centrifuge.

According to a preferred embodiment of the invention slide valve body is provided for rotation around the axis of rotation.

According to a preferred embodiment of the invention the decanter centrifuge comprises a level sensor in the bowl, and a drive for sliding, especially rotating, the slide valve body, thereby providing for automatic and continuous setting of the liquid or substance level and enabling adjustment of the level during operation of the decanter centrifuge.

According to a second aspect of the invention the object is achieved by a decanter centrifuge discharge port member adapted to be placed over an outlet opening of a bowl of a decanter centrifuge, the decanter centrifuge comprising a bowl rotating in use around a horizontal axis of rotation in a direction of rotation, said axis of rotation extending in a longitudinal direction of said bowl and a radial direction extending perpendicular to the longitudinal direction, a base plate provided at a longitudinal end of the bowl and an outlet opening provided in said base plate, said outlet opening extending through a first angular interval relative to said axis of rotation, the decanter centrifuge discharge port member comprising a sole plate for bearing against the base plate, said sole plate having an internal side and an external side, and a wall projecting from said external side of said sole plate for guiding a substance discharged from said outlet opening, wherein said wall extends, when said decanter centrifuge discharge port member is mounted on said decanter centrifuge, from the vicinity of the outlet opening towards a rim of the base plate through a second angular interval adjacent the first angular interval, said second angular interval being at least 30°, preferably at least 45°, more preferably at least 60°, and said wall having in a radial plane perpendicular to the axis of rotation an inclination relative to the radial direction of at least 60°, preferably at least 70°, more preferably at least 75°.

With a decanter centrifuge discharge port member according to the invention it is possible to adapt an existing decanter centrifuge to achieve the abovementioned advantages simply by attaching a decanter centrifuge discharge port member according to the invention to a longitudinal end of the decanter centrifuge. To this end the decanter centrifuge discharge port member may comprise holes adapted to receive fastening means such as bolts.

DESCRIPTION OF THE DRAWINGS

The invention will now be described in further detail based on non-limiting exemplary embodiments, and with reference to the drawings. In the drawings.

DETAILED DESCRIPTION OF THE INVENTION

Figure 1:
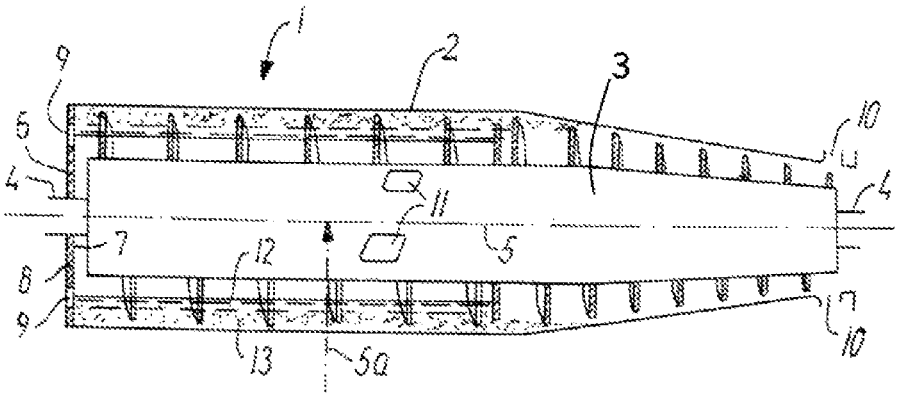
FIG.1 PRIOR ART
FIG. 1 shows a schematic view of an embodiment of a decanter centrifuge of prior art.

FIG. 1 shows a prior art decanter centrifuge 1 comprising a bowl 2 and a screw conveyor 3 which are mounted on a shaft 4 such that they in use can be brought to rotate around an axis 5 of rotation, the axis 5 of rotation extending in a longitudinal direction of the bowl 2. Further, the decanter centrifuge 1 has a radial direction 5*a* extending perpendicular to the longitudinal direction.

For the sake of simplicity directions "up" and "down" are used herein as referring to a radial direction towards the axis 5 of rotation and away from the axis 5 of rotation, respectively.

The bowl 2 comprises a base plate 6 provided at one longitudinal end of the bowl 2, which base plate 6 has an internal side 7 and an external side 8. The base plate 6 is provided with a number of outlet openings 9. Furthermore the bowl 2 is at an end opposite to the base plate 6 provided with solid phase discharge openings 10.

Further the screw conveyor 3 comprises inlet openings 11 for feeding e.g. a slurry to the decanter centrifuge 1, the slurry comprising a light or liquid phase 12 and a heavy or solid phase 13. During rotation of the decanter centrifuge 1 as previously described, separation of the liquid 12 and solid 13 phases is obtained. The liquid phase 12 is discharged through the outlet openings 9 in the base plate 6, while the screw conveyor 3 transports the solid phase 13 towards the solid phase discharge openings 10 through which the solid phase 13 is eventually discharged.

Figure 2:
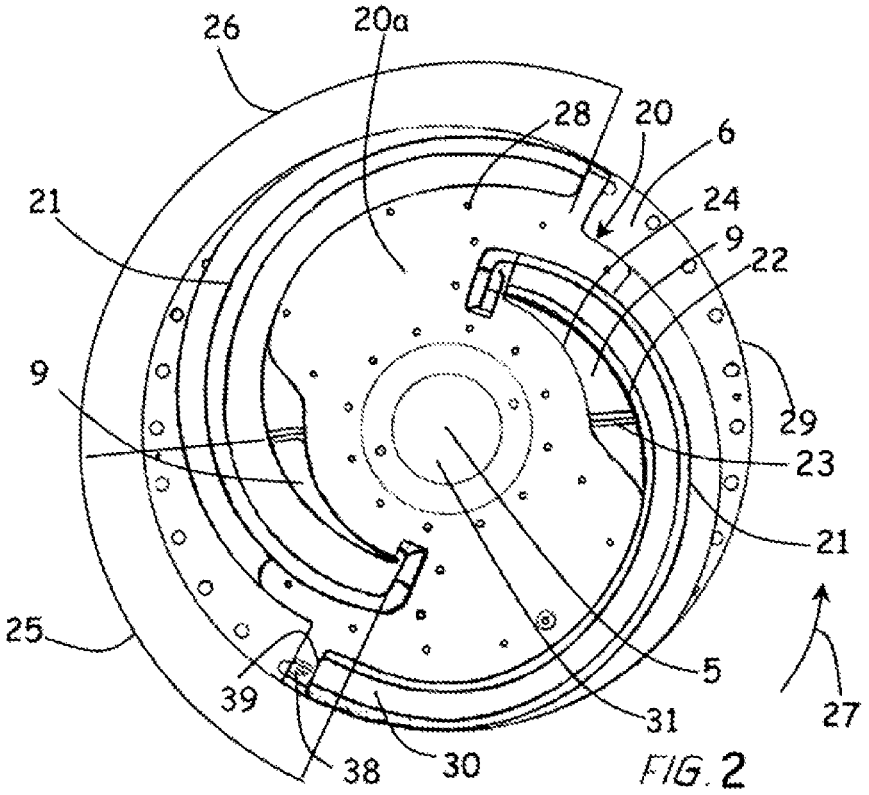
FIG. 2 shows an end view of the base plate of a decanter centrifuge with a decanter centrifuge discharge port member according to the invention in a first embodiment.

Turning to FIG. 2 a base plate 6 of a decanter centrifuge 1 is shown. The base plate 6 is equipped with a decanter centrifuge discharge member 20 according to a first embodiment of the invention mounted on the base plate such that the axis of rotation 5 extends through a central opening 31. The decanter centrifuge discharge member 20 may be mounted using screws or the like inserted through first holes 28. Alternatively, the decanter centrifuge discharge member 20 may be mounted on a decanter centrifuge discharge member base plate (not shown) similar to the base plate 6 shown in FIG. 2 that may then be mounted on the base plate 6 of the decanter centrifuge 1. For mounting the decanter centrifuge discharge member base plate there may be provided holes such as second holes 36. However, in the embodiment shown the second holes 36 are used to mount the base plate 6 on the decanter centrifuge 1. As another alternative the decanter centrifuge discharge member 20 may simply be cast or moulded in one piece with the base plate 6 of the decanter centrifuge.

The base plate 6 comprises a plurality of outlet openings 9. In the embodiment shown in FIG. 2 there is two such outlet openings 9, albeit the exact number of outlet openings remain uncritical. Normally such a plurality of outlet openings are provided in the base plate placed equidistantly on a common radius.

Each outlet opening 9 is delimited by a circumferential edge comprising three parts 22, 23, 24. A first part constitutes a weir edge 22, a second part 23 extends between a first angular interval 25 and a second angular interval 26 from the weir edge 22 towards the axis of rotation 5 and a third part 24 connects the weir edge 22 and the second part 23. The third part 24 extends in the embodiment shown along a drawing of a circle on the base plate 6.

The weir edge 22 is radially away from the axis of rotation 5 forming a delimitation of the outlet opening 9, the weir edge 22 extending through the first angular interval 25 and having in the first angular interval 25 in a radial plane perpendicular to the axis of rotation 5 an inclination relative to the radial direction of about 82°, the first angular interval 25 having an extension of about 60 to 65°. It is noted that the general shape of the outlet opening 9 remains uncritical as long as the weir edge 22 is provided in the first angular interval 25 in a radial plane perpendicular to the axis of rotation 5 with an inclination relative to the radial direction preferably being at least 60°.

The decanter centrifuge discharge member 20 comprises a sole plate 20*a*, which comprises a wall 21. When the decanter centrifuge discharge member 20 is mounted on the base plate 6, the wall 21 extends adjacent each outlet opening 9 in a direction opposite to the direction of rotation denoted by an arrow 27 through the first angular interval 25 along the weir edge 22 with substantially the same inclination relative to the radial direction as the weir edge 22. The transition from weir edge 22 to wall 21 is preferably substantially smooth.

The wall 21 further extends through the second angular interval 26 towards the rim of the sole plate 20*a*, and when mounted towards the rim 29 of the base plate 6, with an inclination relative to the radial direction increasing towards the respective rim. In the embodiments shown the wall 21 has a total angular extension of approximately 180°, thus ending adjacent the rim 29 at the far end 39 of the wall 21 opposite the outlet opening 9. At the rim 29, the inclination of the wall 21 relative to the radial direction has increased from the initial about 82° to about 88° to 90°. Both the angular extension and inclination relative to the radial direction of the wall 21 and the weir edge 22 of the outlet opening 9 may take other values than stated above. However, as a rule of thumb the longer the angular extension of the wall 21 the more efficient the energy recovery obtained. Preferably the angular extension of the wall 21 through the second angular interval 26 is at least 30°.

The wall 21 further comprises a raised part 30, whereby the wall 21 is provided with the shape of an open channel, as will be described in detail below.

At the far end 39 of the wall 21 the decanter centrifuge discharge member 20 comprises a discharge area 38, the liquid phase leaving the wall over the discharge area 38 in a direction substantially opposite the direction of rotation denoted by arrow 27.

Figure 3:
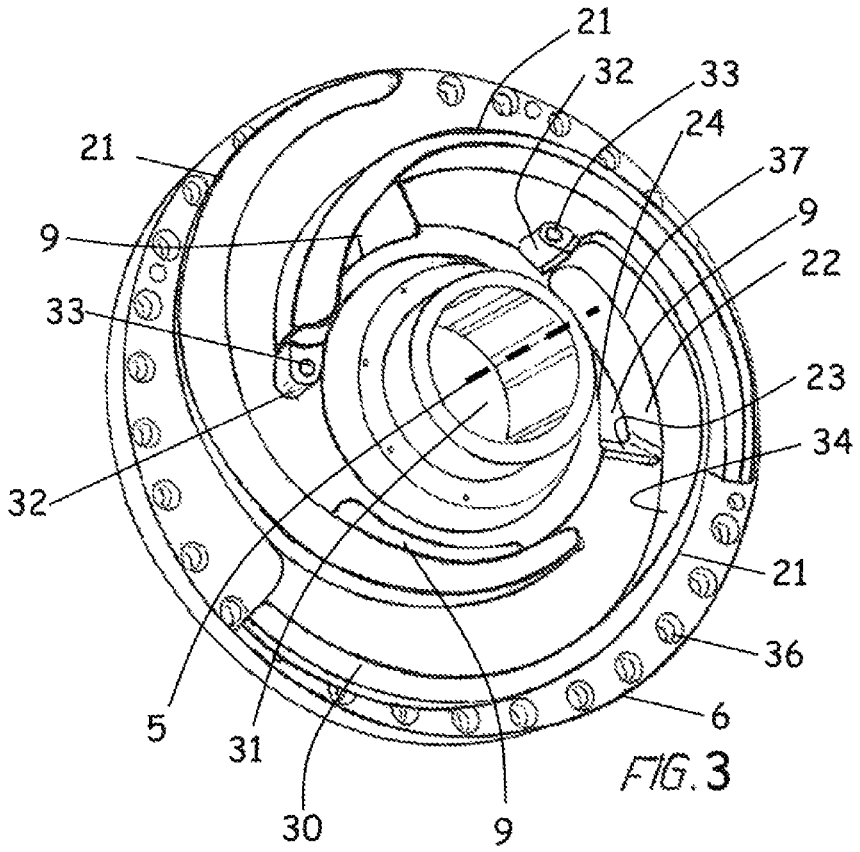
FIG. 3 shows a perspective view of the base plate of a decanter centrifuge a decanter centrifuge discharge port member according to the invention in a second embodiment.

FIG. 3 shows a second embodiment of a base plate 6 equipped with a decanter centrifuge discharge member 20 according to a second embodiment of the invention mounted on the base plate 6. In this embodiment the base plate 6 comprises three outlet openings 9, and the decanter centrifuge discharge member 20 comprises three walls 21. Both outlet openings 9 and walls 21 are substantially positioned as and of the type described above in connection with FIG. 2. In this embodiment the decanter centrifuge discharge member 20 is mounted on the base plate 6 by inserting screws or the like through bushings 33 provided in extensions 32 of each wall 21.

The perspective view of FIG. 3 reveals in more detail that the raised part 30 of the wall 21 provided opposite the base plate 6 serves to provide an open channel 34 for guiding the substance discharged.

Furthermore, it can be seen that the second part 23 of the circumferential edge of the outlet opening 9 may be provided with an inclination with respect to a direction parallel with the axis of rotation 5 and pointing in a direction opposite the direction of rotation (arrow 27). A transition 37 from the outlet opening 9 to the wall 21 is preferably flush to provide a smooth, lossless flow from the outlet 9 onto the wall 21, but a small step to a larger radial distance from the axis of rotation may be present in the transition 37 from the outlet 9 to the wall 21.

Figure 4:
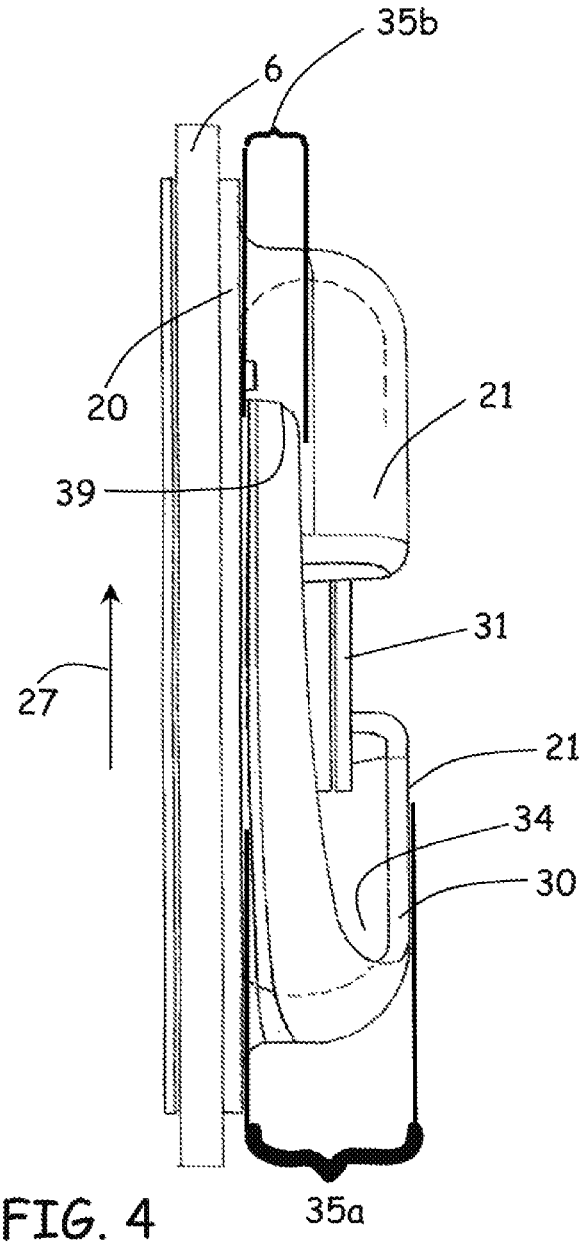
FIG. 4 shows a side view of the base plate of a decanter centrifuge with the decanter centrifuge discharge member according to FIG. 2.

Turning to FIG. 4, a side view of the first embodiment of the base plate 6 and the decanter centrifuge discharge member 20 is shown. From FIG. 4 the course of the wall 21, and in particular of the raised part 30 of the wall 21, becomes clearer. As mentioned, the raised part 30 provides an open channel 34, the curvature of which is marked with a dashed line on FIG. 4. As can be seen the width of the channel decreases through the second angular interval 26 in a direction opposite the direction of rotation (arrow 27) such that it has its largest width 34*a* between the first angular interval 25 and the second angular interval 26 and its smallest width 34*b* at its far end 39.

Figure 5:
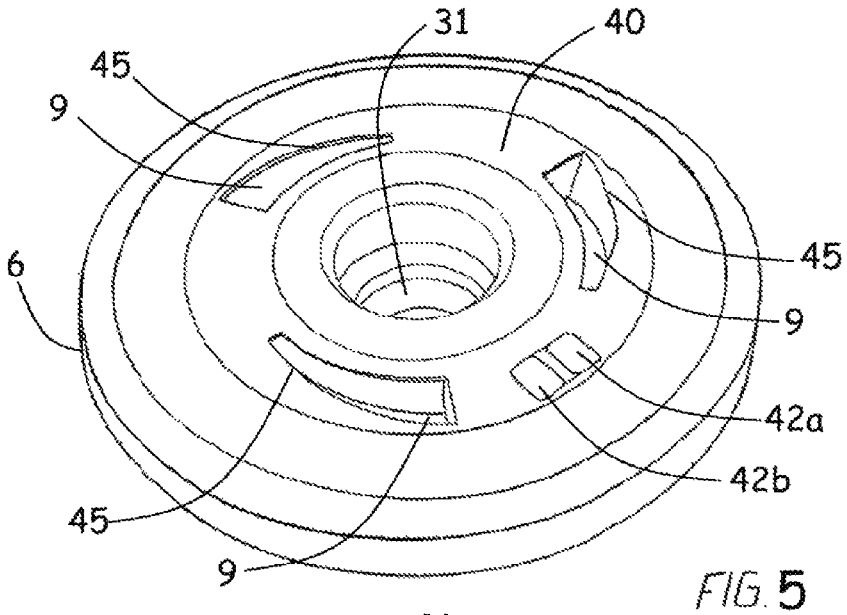
FIG. 5 shows a bottom view of a base plate of a decanter centrifuge according to the second embodiment of the invention featuring a slide valve body.

FIG. 5 features the base plate 6 according to the second embodiment seen from below having three outlet openings 9, each with a circumferential edge substantially as described above. On the base plate 6 is provided a slide valve body 40 in one piece comprising three openings 45 corresponding in shape and orientation to the outlet openings 9. Alternatively there may be provided a separate slide valve body for each outlet opening in the base plate 6.

The slide valve body is in FIG. 5 shown in its open position, the outlet openings 9 being completely free. The slide valve body 40 is mounted such as to be able to rotate around the axis of rotation. Furthermore the slide valve body 40 may comprise adjustment means (not shown) for sliding or rotating the slide valve body 40. Such an adjustment means is preferably a, preferably automatic, drive means, but may also be e.g. a manual adjustment means.

Furthermore, the slide valve body 40 comprises a level sensor comprising two sensor elements 42*a*, 42*b*. The sensor elements 42*a*, 42*b* are in a preferred embodiment sensor elements such as RFID sensor elements for monitoring (i.e. measuring and communicating to an external device or the above mentioned adjustment means) the liquid level in the bowl 2 of the decanter centrifuge 1. Such sensor elements are in principle capacitive elements sensing a change of the liquid level by a change in the dielectric value between the capacitor plates. The sensor elements 42*a*, 42*b* are connected to a coil 43 (cf. FIG. 6) that is concentric with the axis of rotation 5 providing a resonance circuit. The change in dielectric value between the capacitor plates of the sensor elements 42*a*, 42*b* causes a change in resonance frequency. The resonance frequency can be picked up by an is then communicated to the external sensor, which also regularly will excite the resonance circuit. In this way the liquid level in the bowl 2 may be monitored during operation of the decanter centrifuge 1, and the slide valve body 40, if comprising a drive means as described above, may instantly be rotated in response to the liquid level measurement.

Figure 6:
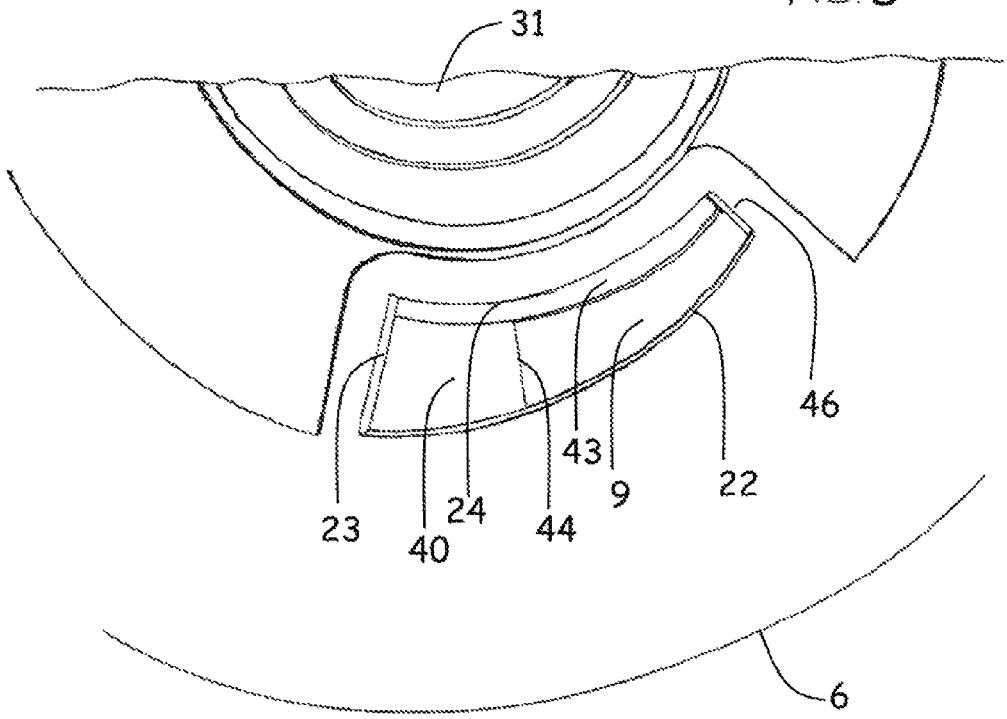
FIG. 6 shows a sectional end view of the base plate of a decanter centrifuge according to FIG. 4 showing one discharge opening with the slide valve body in a partially closed position.

FIG. 6 shows a close up of a section of a base plate 6 seen from the end in the longitudinal direction and with the decanter centrifuge discharge member 20 removed. As can be seen the slide valve body 40 has been rotated, such that it partially covers the outlet opening 9. The liquid discharged through the outlet opening 9 is thus forced out where the radius of the outlet opening 9 is smaller, the edge 44 of the slide valve body 40 thus determining the liquid level in the bowl. The outlet opening 9 may even be closed by means of the slide valve body 40.

Furthermore, in the embodiment shown in FIG. 6, the third part 24 of the circumferential edge of outlet opening 9 connecting the weir edge 22 and the second part 23 is generally L-shaped comprising a small leg 46.

Figure 7:
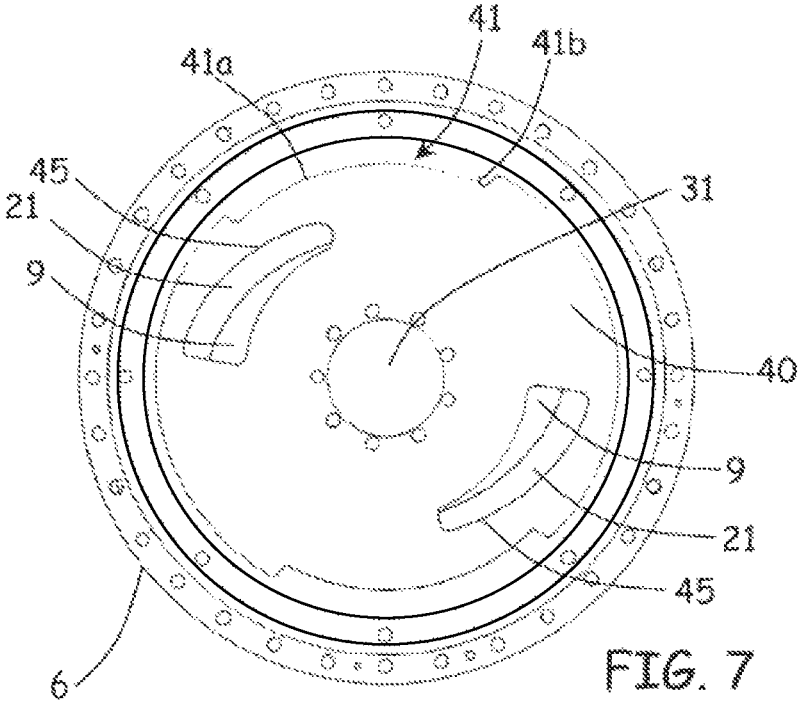
FIG. 7 shows a bottom view of a base plate of a decanter centrifuge according to the first embodiment of the invention featuring a slide valve body.

FIG. 7 shows a second embodiment of a base plate 6 comprising a slide valve body 40 according to the invention. In this embodiment, the slide valve body comprises two openings corresponding in shape to the two outlet openings 9 of the base plate 6. Furthermore, the slide valve body 40 is provided with a stop mechanism 41 for limiting the angular interval through which the slide valve body 40 may be rotated.

It should be noted that the above description of preferred embodiments is merely an example, and that the skilled person would know that numerous variations are possible without departing from the scope of the claims.

The invention claimed is:

1. A decanter centrifuge for separating a first substance and a second substance with different densities comprising:

a bowl rotating in use around a horizontal axis of rotation in a direction of rotation, said axis of rotation extending in a longitudinal direction of said bowl;

a radial direction extending perpendicular to the longitudinal direction;

a base plate provided at one longitudinal end of said bowl, said base plate having an internal side and an external side, an outlet opening provided in said base plate for discharge of one of said substances, said outlet opening extending through a first angular interval relative to the axis of rotation, and a wall projecting from said external side of said base plate for guiding the substance discharged from said outlet opening in a direction opposite a direction of rotation of the bowl to recover kinetic energy from the substance, wherein said wall extends from the vicinity of the outlet opening towards a rim of the base plate, said wall extending through a second angular interval adjacent the first angular interval, said second angular interval being at least 30° and said wall having in a radial plane perpendicular to the axis of rotation an inclination relative to the radial direction of at least 60°.

2. A decanter centrifuge according to claim 1, wherein the inclination of the wall relative to the radial direction is increasing through the second angular interval in a direction opposite the direction of rotation of the bowl.

3. A decanter centrifuge according to claim 1, wherein that the outlet is radially away from the axis of rotation delimited by a weir edge, the wall extending through the first angular interval along said weir edge, the wall and the weir edge having in at least a major part of the first angular interval in a radial plane perpendicular to the axis of rotation an inclination relative to the radial direction of at least 60°.

4. A decanter centrifuge according to claim 3, wherein said outlet opening is delimited by a circumferential edge comprising three parts, a first part constituting the weir edge, a second part extending between the first and the second angular interval from the weir edge towards the axis of rotation and a third part connects the first part and the second part.

5. A decanter centrifuge according to claim 3, wherein the wall and the weir edge has in at least a major part of the first angular interval in a radial plane perpendicular to the axis of rotation an inclination relative to the radial direction of at least 70°.

6. A decanter centrifuge according to claim 3, wherein the wall and the weir edge has in at least a major part of the first angular interval in a radial plane perpendicular to the axis of rotation an inclination relative to the radial direction of at least 75°.

7. A decanter centrifuge according to claim 1, wherein the wall comprises a raised part opposite the base plate, the wall providing an open channel for guiding the substance discharged.

8. A decanter centrifuge according to claim 7, wherein the channel has a width, said width decreasing through the second angular interval in a direction opposite the direction of rotation.

9. A decanter centrifuge according to claim 1, wherein said base plate comprises a plurality of outlet openings, and a plurality of walls projecting from said base plate.

10. A decanter centrifuge according to claim 9, wherein said base plate comprises three outlet openings and three walls projecting from said base plate.

11. A decanter centrifuge according to claim 9, wherein said base plate comprises a wall for each outlet opening.

12. A decanter centrifuge according to claim 1, wherein the decanter centrifuge further comprises a slide valve body adapted for covering an adjustable part of the outlet opening.

13. A decanter centrifuge according to claim 12, wherein said slide valve body is provided for rotation around the axis of rotation.

14. A decanter centrifuge according to claim 12, wherein the decanter centrifuge further comprises a level sensor in the bowl.

15. A decanter centrifuge according to claim 1, wherein said second angular interval is at least 45°.

16. A decanter centrifuge according to claim 1, wherein said second angular interval is at least 60°.

17. A decanter centrifuge according to claim 1, wherein said wall has in a radial plane perpendicular to the axis of rotation an inclination relative to the radial direction of at least 70°.

18. A decanter centrifuge according to claim 1, wherein said wall has in a radial plane perpendicular to the axis of rotation an inclination relative to the radial direction of at least 75°.

19. A decanter centrifuge discharge port member adapted to be placed over an outlet opening of a bowl of a decanter centrifuge, the decanter centrifuge comprising a bowl rotating in use around a horizontal axis of rotation in a direction of rotation, said axis of rotation extending in a longitudinal direction of said bowl and a radial direction extending perpendicular to the longitudinal direction, a base plate provided at a longitudinal end of the bowl and an outlet opening provided in said base plate, said outlet opening extending through a first angular interval relative to said axis of rotation, the decanter centrifuge discharge port member comprising a sole plate for bearing against the base plate, said sole plate having an internal side and an external side, and a wall projecting from said external side of said sole plate for guiding a substance discharged from said outlet opening, wherein said wall extends, when said decanter centrifuge discharge port member is mounted on said decanter centrifuge, from the vicinity of the outlet opening towards a rim of the base plate through a second angular interval adjacent the first angular interval, said second angular interval being at least 30° and said wall having in a radial plane perpendicular to the axis of rotation an inclination relative to the radial direction of at least 60°.

20. A decanter centrifuge discharge port member according to claim 19, wherein the wall comprises a raised part opposite the sole plate, the wall providing an open channel for guiding the substance discharged.

21. A decanter centrifuge discharge port member according to claim 19, wherein said base plate comprises a plurality of outlet openings, wherein said sole plate comprises a plurality of walls projecting from said sole plate.

22. A decanter centrifuge discharge port member according to claim 21, wherein said base plate comprises three outlet openings and three walls projecting from said base plate.

23. A decanter centrifuge discharge port member according to claim 21, wherein said base plate comprises a wall for each outlet opening.

24. A decanter centrifuge discharge port member according to claim 19, wherein said second angular interval is at least 45°.

25. A decanter centrifuge discharge port member according to claim 19, wherein said second angular interval is at least 60°.

26. A decanter centrifuge discharge port member according to claim 19, wherein said wall has in a radial plane perpendicular to the axis of rotation an inclination relative to the radial direction of at least 70°.

27. A decanter centrifuge discharge port member according to claim 19, wherein said wall has in a radial plane perpendicular to the axis of rotation an inclination relative to the radial direction of at least 75°.

* * * * *